US010156130B2

(12) United States Patent
Kamphaus et al.

(10) Patent No.: US 10,156,130 B2
(45) Date of Patent: Dec. 18, 2018

(54) PRESSURE RELIEF SYSTEM FOR GAS LIFT VALVES AND MANDRELS

(71) Applicant: Schlumberger Technology Corporation, Sugar Land, TX (US)

(72) Inventors: Jason Michael Kamphaus, Missouri City, TX (US); Eric Lovie, Singapore (SG)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 59 days.

(21) Appl. No.: 15/022,327

(22) PCT Filed: Sep. 18, 2014

(86) PCT No.: PCT/US2014/056308
§ 371 (c)(1),
(2) Date: Mar. 16, 2016

(87) PCT Pub. No.: WO2015/042265
PCT Pub. Date: Mar. 26, 2015

(65) Prior Publication Data

US 2016/0222769 A1 Aug. 4, 2016

Related U.S. Application Data

(60) Provisional application No. 61/900,386, filed on Nov. 5, 2013, provisional application No. 61/879,160, filed on Sep. 18, 2013.

(51) Int. Cl.
*E21B 43/12* (2006.01)

(52) U.S. Cl.
CPC ..... *E21B 43/123* (2013.01)

(58) Field of Classification Search
CPC ..... E21B 43/123
See application file for complete search history.

(56) References Cited

U.S. PATENT DOCUMENTS 2,634,689 A * 4/1953 Walton ..... E21B 43/123 417/112
3,993,129 A * 11/1976 Watkins ..... E21B 34/08 137/155

(Continued)

FOREIGN PATENT DOCUMENTS

EP 2708696 A2 3/2014

OTHER PUBLICATIONS

PCT/US2014/056308, International Search Report and Written Opinion, dated Dec. 29, 2014, 14 pgs.

(Continued)

*Primary Examiner* — Brad Harcourt

(57) ABSTRACT

Pressure relief systems for gas lift valves and mandrels are provided. In an implementation, a gas lift barrier mandrel includes two gas lift valves in series fluid communication. When fluid becomes confined between the two gas lift valves, an expansion volume is provided in one of the gas lift valves for pressure relief of the confined fluid, beginning at a pressure threshold value. The pressure relief may be mediated by a pressure-activated device, a piston, a spring, or a bellows to regulate the expansion of confined pressure. In an implementation, one of the gas lift valves may include a pressure relief valve to vent confined pressure from the gas lift valve to the production tubing or casing annulus. A check valve may be added in series with the pressure relief valve within the gas lift valve to prevent backflow through the pressure relief valve.

13 Claims, 10 Drawing Sheets

(56) References Cited

U.S. PATENT DOCUMENTS

| | | | |
|---|---|---|---|
| 6,070,608 | A | 6/2000 | Pringle |
| 8,381,821 | B2 | 2/2013 | Hahn et al. |
| 2004/0069491 | A1 | 4/2004 | Garay et al. |
| 2011/0315401 | A1 | 12/2011 | White et al. |
| 2012/0292034 | A1 | 11/2012 | Fay |

OTHER PUBLICATIONS

Combined Search and Examination Report for corresponding GB Application Serial No. 1617052.4, dated Nov. 15, 2016, 6 pages.

* cited by examiner

PRESSURE RELIEF SYSTEM FOR GAS LIFT VALVES AND MANDRELS

RELATED APPLICATIONS

This patent application claims the benefit of priority to U.S. Provisional Patent Application No. 61/879,160 to Kamphaus et al., filed Sep. 18, 2013, and incorporated by reference herein in its entirety, and claims the benefit of priority to U.S. Provisional Patent Application No. 61/900,386 to Kamphaus et al., filed Nov. 5, 2013, and incorporated by reference herein in its entirety.

BACKGROUND

Gas lift is a form of artificial lift for liquid hydrocarbon wells. Gas bubbles are introduced into the vertical production tube that outlets the hydrocarbon resource from the well. The rising bubbles of injected gas reduce the hydrostatic pressure of the fluid column in the production tube as compared with the reservoir below and aerate the fluid to reduce its density. The inherent reservoir pressure below is then able to lift the hydrocarbon fluid out of the wellbore via the production tube.

A gas lift mandrel is a device installed in or on the tubing string of a gas lift well. Each gas lift mandrel is fitted with one or more gas lift valves. In a side-pocket type of gas lift mandrel, the gas lift valve can be installed and removed by wireline while the mandrel is still in the well, eliminating the need to pull the production tubing to repair or replace the gas lift valve.

One or more gas lift valves may reside in each gas lift mandrel to inject pressurized gas from the well casing annulus into the production tubing. Pressures in the production tubing and in the casing annulus cause the gas lift valves to open and close, thus allowing gas to be injected into the fluid in the tubing to cause the fluid to rise to the surface.

A barrier-type mandrel and associated gas lift barrier valves prevent well fluid from flowing backwards from the production tubing into the well casing space when pressurized gas is not being injected, and maintain a barrier during valve replacement operations when one of the gas lift barrier valves is being removed for replacement or repair.

SUMMARY

Pressure relief systems for gas lift valves and mandrels are described. In an implementation, a gas lift mandrel includes at least a flow check system and an expansion volume reserved for relieving a pressure of a fluid confined in the gas lift mandrel, beginning at a threshold pressure value. In an implementation, an apparatus includes a gas lift mandrel and at least a flow check system in the gas lift mandrel, and a pressure relief valve within a gas lift valve of the mandrel allowing the pressure of a fluid confined in the mandrel to vent from the gas lift valve. An example method includes constructing a gas lift mandrel with at least a flow check system, and providing a relief for the pressure of a confined fluid in the gas lift mandrel. This summary is not intended to identify key or essential features of the claimed subject matter, nor is it intended to be used as an aid in limiting the scope of the claimed subject matter.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

Figure 1:
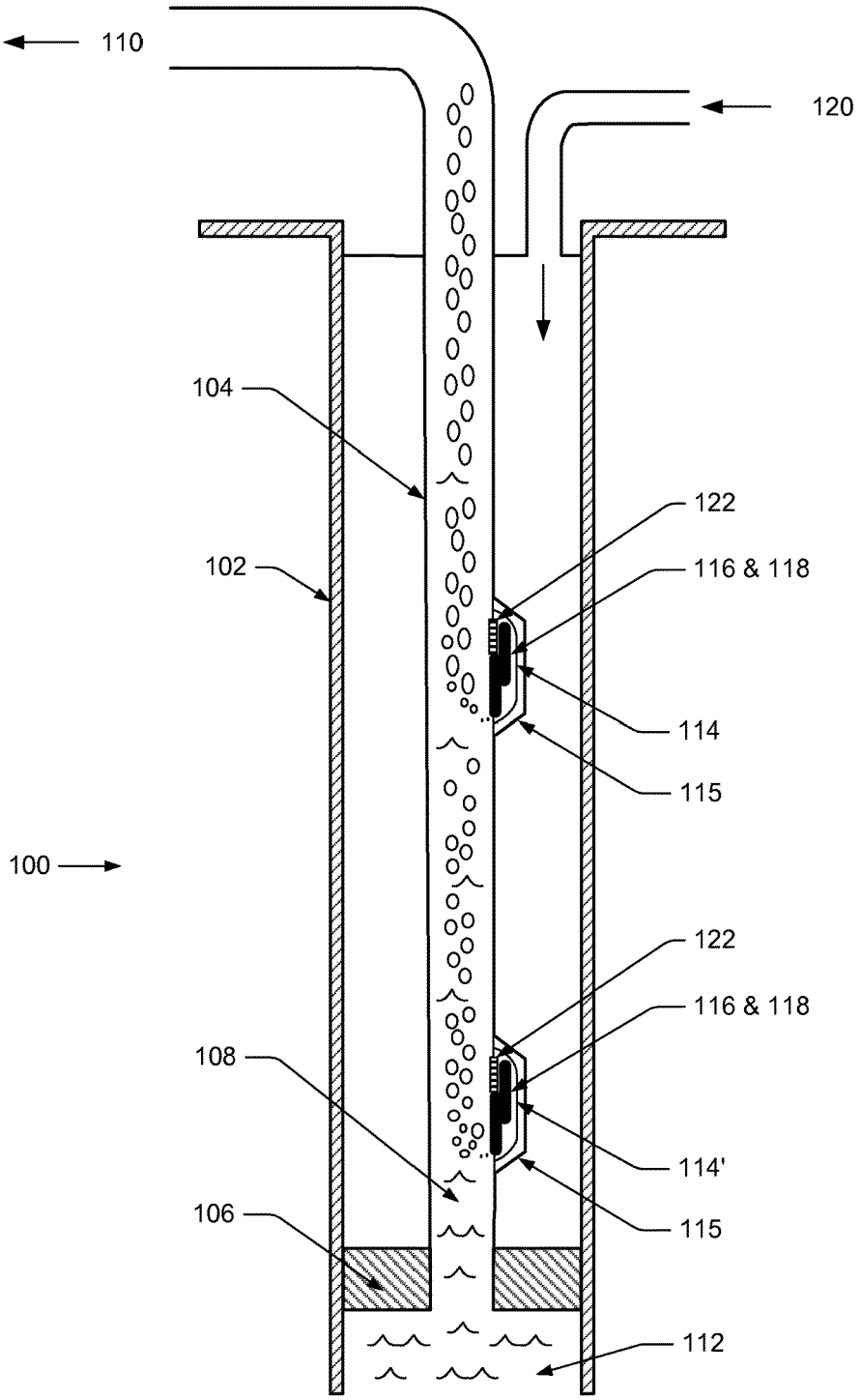
FIG. 1 is a diagram of an example gas lift operation with side-pocket barrier mandrels placed to inject gas into a tubing string in a wellbore.

This disclosure describes pressure relief systems for gas lift valves and mandrels. FIG. 1 shows an example well (or wellbore) 100 lined with a well casing 102, in which production tubing (also "tubing string" or "tube") 104 penetrates a packer 106, which otherwise blocks-off the well 100. The interior bore of the production tube 104 provides a production conduit 108 through which a hydrocarbon resource 110 is produced from a formation or reservoir 112 below the ground surface.

One or more gas lift barrier mandrels (GLBMs) 114 & 114' may be incorporated in or onto (a side pocket 115 of)

the production tube 104 to implement gas lift of the hydrocarbon resource 110. Each gas lift barrier mandrel 114 may include gas lift valves 116 & 118, such as barrier valves, which inject a gas 120 into the production tubing 104 for gas lift of the hydrocarbon resource 110, and regulate the amount of gas 120 injected by opening and closing according to pressure in the production tube 104 versus pressure of the gas 120 between the production tube 104 and the casing 102, being provided from the surface.

Each gas lift barrier mandrel 114 may have a system of gas lift valves 116 that can unintentionally confine or trap fluid between the valves 116 & 118. The confined fluid may be at least partially volatile liquid and/or one or more gases. Under certain conditions, such as normal heating or other rise in temperature, the confined fluid can become destructive to the apparatus, or exceed the operating limits of the valves and/or mandrel. The example mandrels 114 and example gas lift valves 116 & 118 described herein provide implementations of a pressure relief system 122 for this trapped fluid. The pressure relief systems 122 described herein may also be used in other types of valves and mandrels for the hydrocarbon industry in which a fluid becomes confined or trapped, or in situations where a trapped volume of fluid may need to expand.

In a basic wellsite system, such as the example wellbore 100 of FIG. 1, an example gas lift barrier mandrel 114 with pressure relief system 122 may operate as part of the tubing string 104 just as conventional gas lift side-pocket mandrels do. The example gas lift barrier mandrel 114 with pressure relief system 122 can mate to the tubing string 104 using widely available threads, including but not limited to premium threads. The manner of deployment of the example gas lift barrier mandrel 114 with pressure relief system 122 can be the same as for conventional standard gas lift mandrels. An example gas lift valve 116 or 118 inserted into the example gas lift barrier mandrel 114 can be retrieved and installed via a slickline operation using standard kick-over tools in much the same manner as for conventional standard gas lift side-pocket mandrels.

Figure 2:
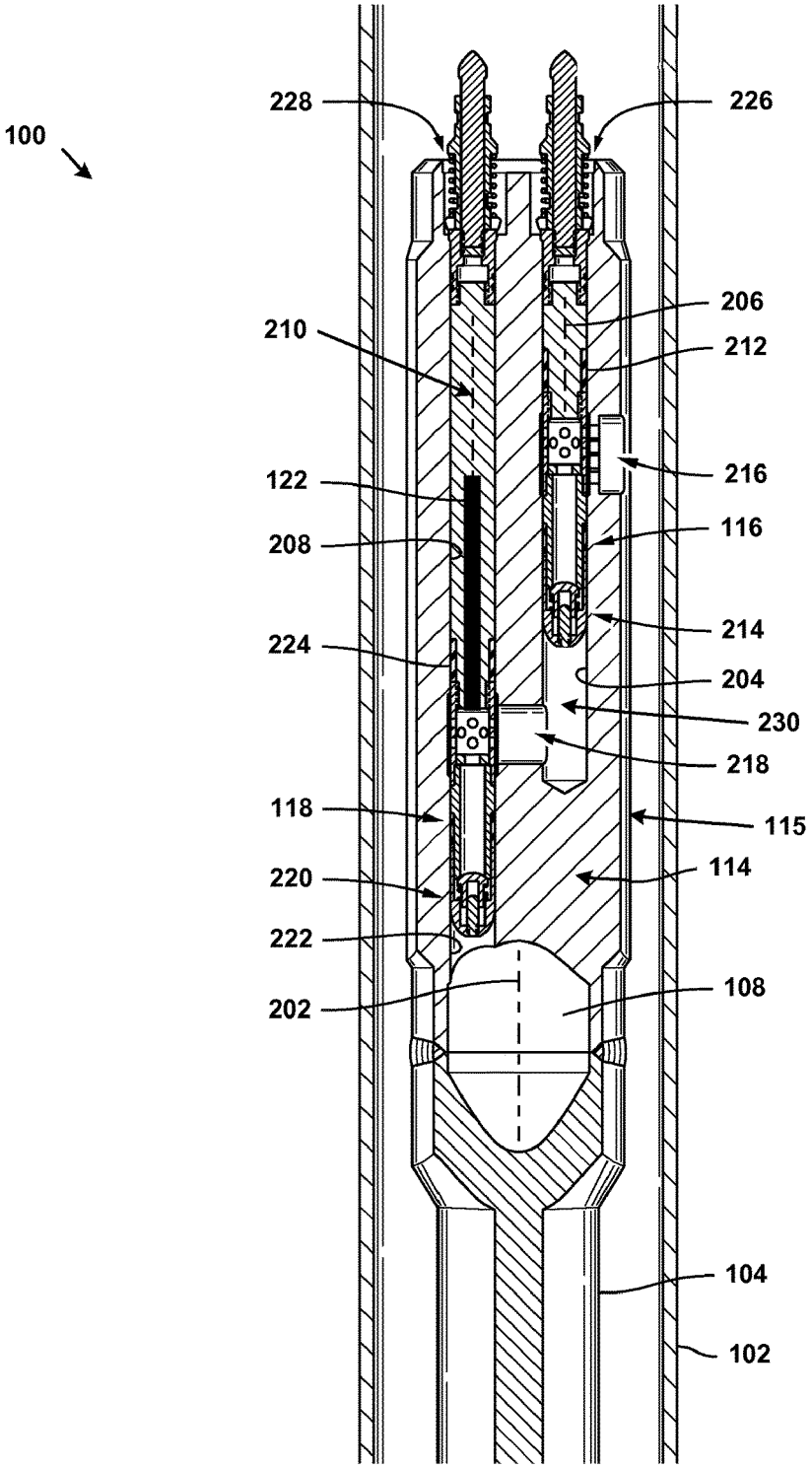
FIG. 2 is a diagram of a side-pocket portion of an example gas lift barrier mandrel, including barrier valves and an example pressure relief system.

FIG. 2 shows an example of the side-pocket gas lift barrier mandrel 114 of FIG. 1, in greater detail. An instructive gas lift barrier mandrel assembly providing some example features and configurations as a starting point for the example pressure relief system 122 described herein can be found in U.S. Patent Publication No. 2011/0315401 to White, which is incorporated by reference herein in its entirety.

The example gas lift barrier mandrel 114 can be located, for example, in a mandrel side pocket 115 connected with production tubing 104 that is located within a wellbore 100 lined with a casing 102. At least part of the bore or conduit 108 of the production tubing 104 extends through the gas lift barrier mandrel 114. The production tubing bore 108 has a central axis 202, and a first pocket 204 of the gas lift barrier mandrel 114 is located adjacent to the production tubing bore 108. The first pocket 204 also has a respective central axis 206 parallel to the bore 108 of the production tube 104. A second pocket 208 is located in the gas lift barrier mandrel 114 and also has a respective central axis 210 parallel to the aforementioned axes. The pockets 204 & 208 can be cylindrical in shape.

In an implementation, the gas lift barrier mandrel 114 includes two separate, distinctly retrievable flow control check valve devices that work independently to simultaneously meet flow control and pressure barrier system requirements.

For example, in an implementation, a first gas lift barrier valve 116 can be located in the first pocket 204. The first gas lift barrier valve 116 may be a tubing-to-casing barrier valve (TCBV). The first gas lift barrier valve 116 may prevent communication between the production tubing 104 and the casing 102 (annulus), when a second gas lift valve is removed from the second pocket 208. The first gas lift barrier valve 116 forms a seal 212 with the inside of the pocket 204. A one-way-check-valve 214 in the first gas lift barrier valve 116 allows flow only in one direction. A port 216 connects the outside of the gas lift barrier mandrel 114 to the inside of the first pocket 204 and the inside of the first gas lift barrier valve 116. Gas 120 can pass though the port 216 and through the one-way-check-valve 214 into a port 218.

From the port 218, the gas 120 can pass into the second pocket 208 and into a second ("live") gas lift barrier valve 118. Thus, the second, live gas lift barrier valve 118 and the first TCBV gas lift barrier valve 116 are in series fluid communication with each other. The live valve 118 may be longer in axial length than the first TCBV gas lift barrier valve 116. In an implementation, the second, live, gas lift barrier valve 118 is the operating valve for gas lift, which injects the gas 120 into the production tubing 104. The live valve 118 can be one of many valve types. For example, a live valve 118 may be a dummy, shear orifice, burst disk, or other valve type that can permanently or temporarily restrict fluid flow.

The gas 120 provided under pressure from the surface, after passing through the first TCBV gas lift barrier valve 116, passes though a one-way-check-valve 220 of the second live gas lift barrier valve 118 and though an opening 222 into the conduit 108 of the production tubing 104. The second gas lift barrier valve 118 has a seal 224 that seals with the inside of the second pocket 208. Due to the seals 212 & 224 of the first gas lift barrier valve 116 and the second gas lift barrier valve 118, gas 120 traveling along the aforementioned path is prevented from passing via openings 226 & 228 of each pocket 204 & 208 into the production conduit 108. The openings 226 & 228 are used to place the gas lift barriers valves 116 & 118 into the pockets 204 & 208, during assembly.

In an implementation, the gas lift barrier mandrel 114 is integrated with the production tubing 104. The outside diameter of the gas lift barrier mandrel portion is generally larger than the outside diameter of the production tubing 104, while the contour of the production conduit or bore 108 remains substantially uninterrupted.

Fluids and gases can become confined in the interstitial space 230 between the first gas lift barrier valve 116 and the second gas lift barrier valve 118. Fluid trapped in the interstitial volume 230 can expand upon heating, causing a rise in the pressure in this region. The example pressure relief system 122 for the confined fluids may be implemented in various ways in the gas lift barrier mandrel 114. These different embodiments are shown in the succeeding Figures.

Barrier-type gas lift mandrels 114 may be distinct from general gas lift mandrels in that the barrier-type may have two or more flow check devices in series as viewed from the perspective of an incoming flow of gas 120. The check system is often accomplished with two or more valves 116 & 118. When one of the valves is a dummy valve, a shear orifice, a burst disk valve, or other flow control device that can temporarily or permanently prevent flow, then there can be a volume of fluid that becomes trapped or backed-up within the mandrel 114. This fluid may acquire increased energy to expand due to increases in temperature, and as such the pressure of the trapped fluid increases because the interstitial volume 230 between the valves 116 & 118 is held constant. The example systems 122 described herein provides means for reducing this pressure to safe levels.

Example Pressure Relief Systems

Figure 3:
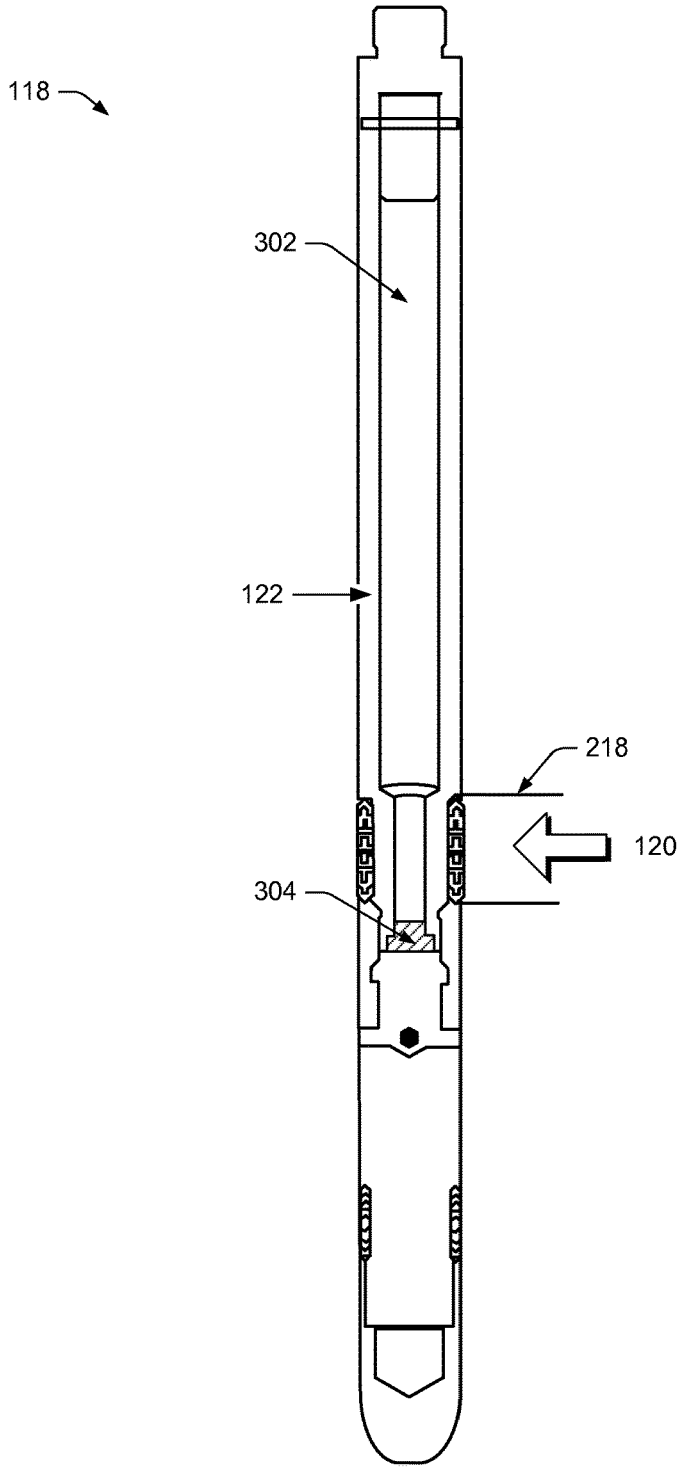
FIG. 3 is a diagram of an example pressure relief system for gas lift mandrels including an additional space in a valve body and a pressure-activated device for relieving pressure into the additional space.

FIG. 3 shows an example pressure relief system 122 for gas lift valves 116 & 118 and mandrel 114. The example system 122 employs a hollow valve body 302 in the live gas lift valve 118, with a pressure-activated device 304, such as a burst disk or shear bar, at the opening of the empty volume in the valve body 302. Once the pressure in the interstitial space (230 in FIG. 2) reaches a predetermined set value, the pressure-activated device 304 opens. The open pressure-activated device 304 allows the pressured fluid to expand into the additional space 302 (expansion chamber or empty volume) in the hollow valve body 302, which reduces the pressure of the fluid below critical levels.

In the implementation of FIG. 3, it is useful to have an expansion volume 302 that the expanding fluid can grow into but that does not allow the fluid to enter until a preset pressure is reached. In this scenario, the pressure-activated device 304 separates the interstitial volume 230 and the expansion volume 302 that the fluid expands into.

There are various alternative implementations of the pressure relief system 122 for gas lift that can be combined in different ways to provide the desired pressure relief.

Figure 4:
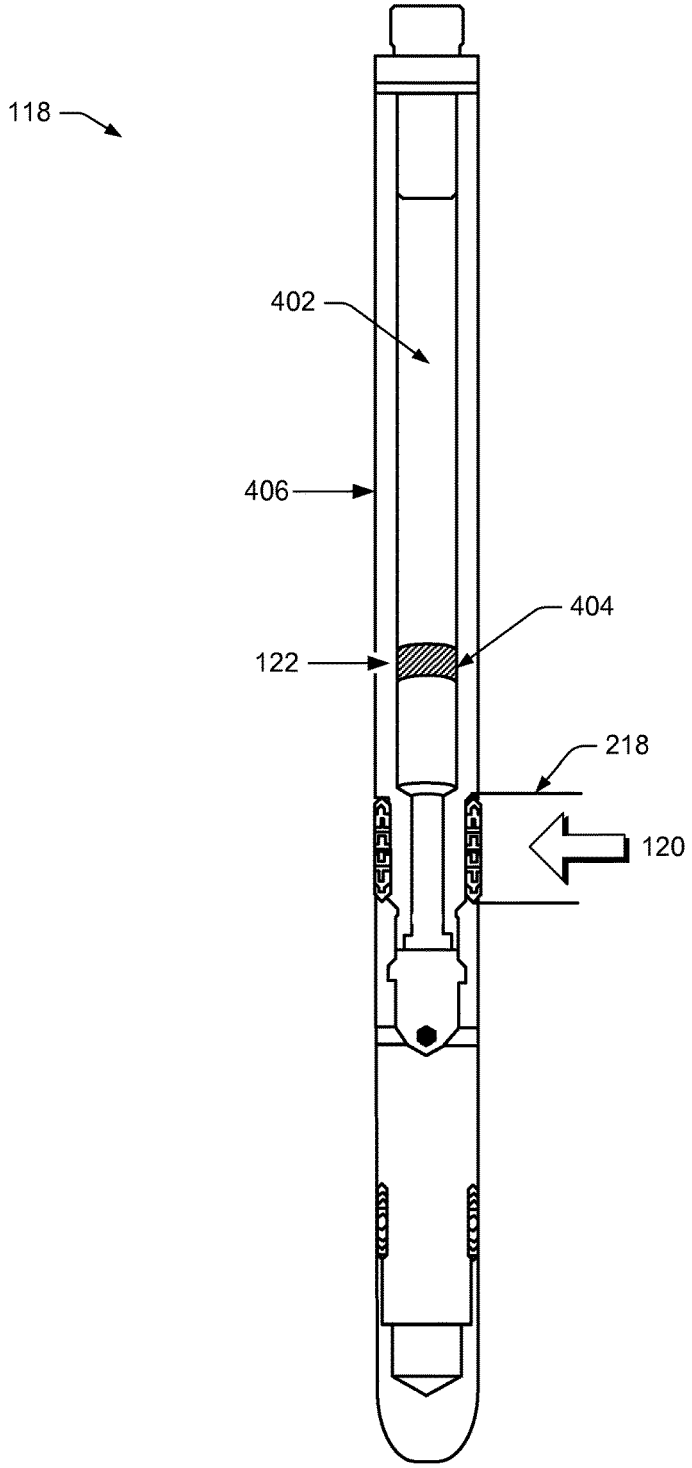
FIG. 4 is a diagram of an example pressure relief system for gas lift mandrels including a gas-charged additional space behind a piston in a valve body for relieving pressure into the gas-charged additional space.

For example, in an implementation of the example pressure relief system 122 for gas lift valves 116 & 118 and mandrels 114 shown in FIG. 4, a gas-charged volume 402 acts on a piston 404 in the valve body 406. The piston 404 separates the two volumes, i.e., the interstitial volume 230 containing the pressured fluid and the gas-charged extra expansion volume 402 for the pressured fluid to expand into, via seals between the piston 404 and the valve body 406. The piston 404 acts to regulate the pressure in the interstitial volume 230. As the pressure of the interstitial volume 230 rises, the piston 404 moves in response, thereby allowing reduction of the pressure of the fluid in the interstitial volume 230. The degree of movement of the piston 404 is determined by the compressibility of the gas charge 402 in the volume of the valve body 406. The pressure in the valve body volume 406 can be set to control the rate of pressure relief.

Figure 5:
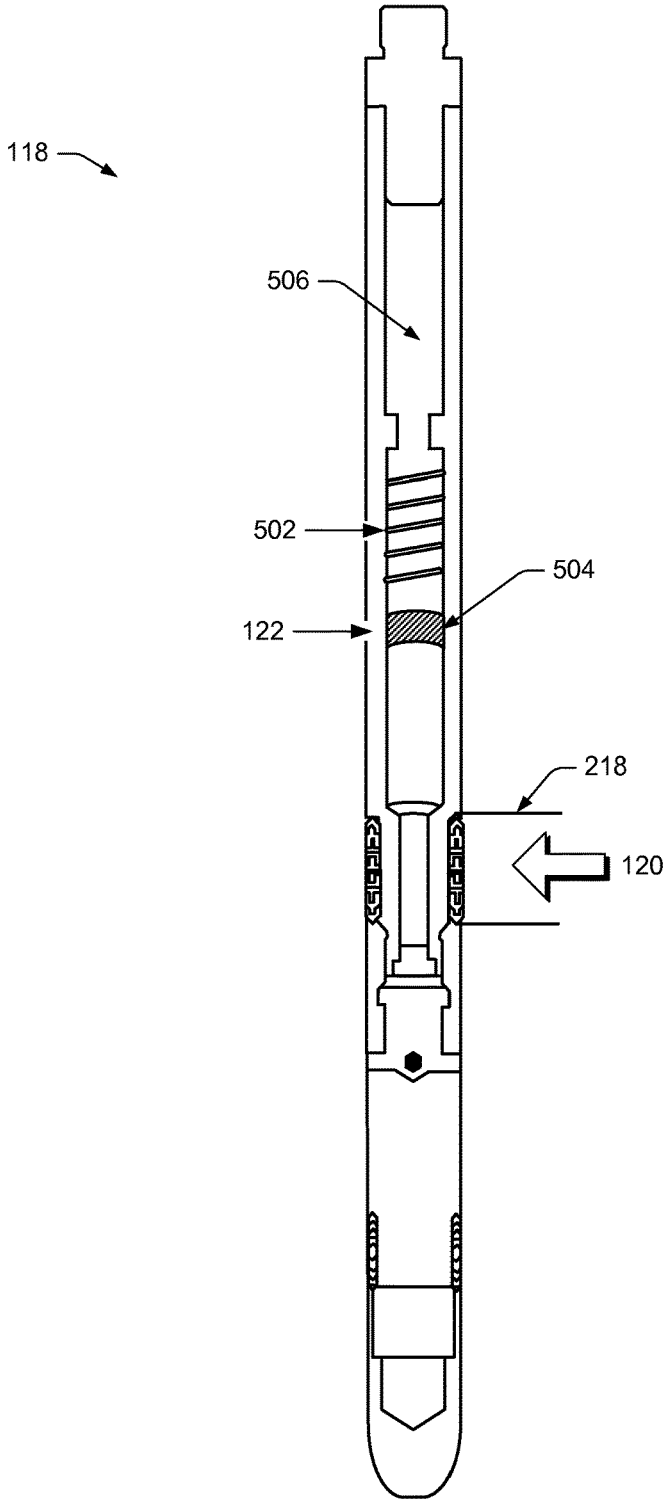
FIG. 5 is a diagram of an example pressure relief system for gas lift mandrels including a valve with an expansion volume, at ambient pressure or containing a pressurized gas, behind a piston that compresses a spring for a pressured fluid to expand.

FIG. 5 shows another embodiment of the pressure relief system 122 for gas lift valves 116 & 118 and mandrels 114. In FIG. 5, the live valve 118 includes a spring 502 to provide resistance to movement of a piston 504. The piston separates the two volumes, the interstitial volume 230 and the second, expansion volume 506 contained within the valve 118 that provides space for the pressured fluid to expand. Besides the spring 502, the expansion volume 506 within the valve 118 can also be pressurized with a gas charge to provide additional resistance to movement of the piston 504, or, the expansion volume 506 can be at ambient pressure. The force of the spring 502 and the resistance of the expansion volume 506 can be selected to control the degree of pressure relief available.

Figure 6:
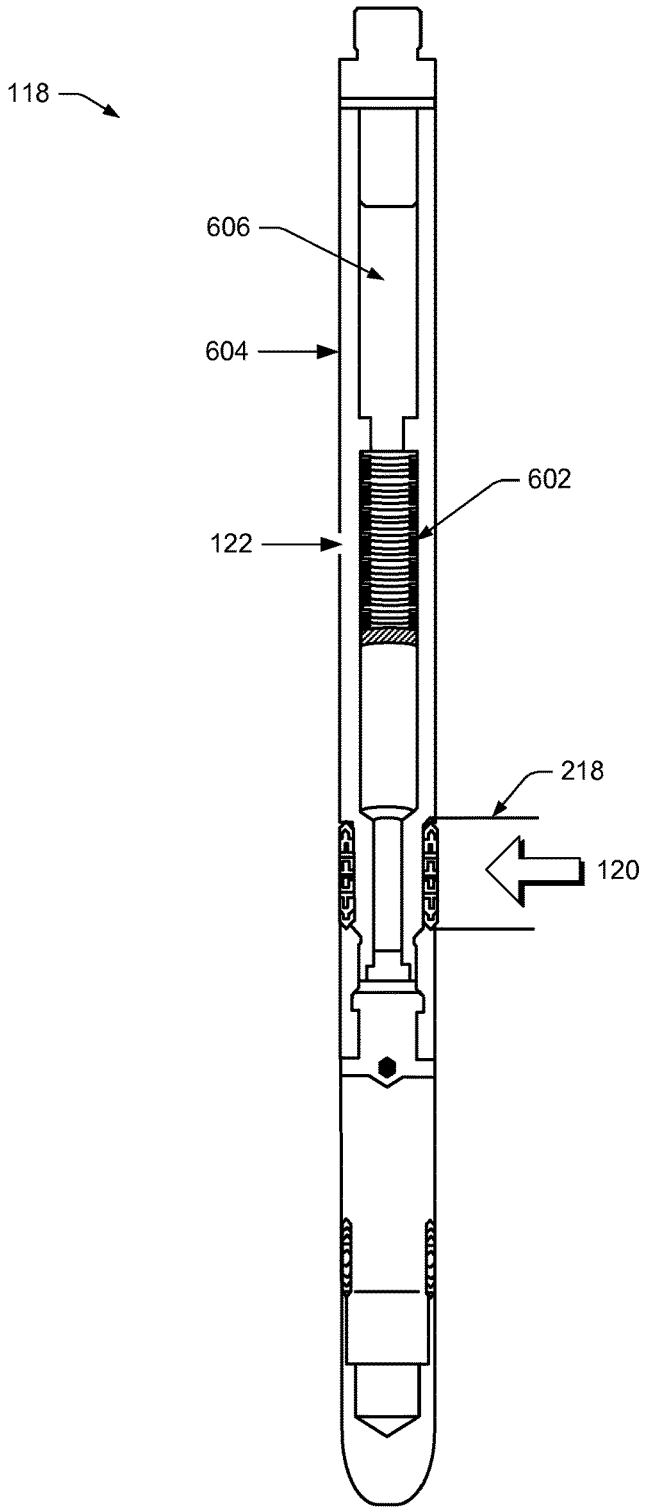
FIG. 6 is a diagram of an example pressure relief system for gas lift mandrels including a gas lift valve with an expansion volume, at ambient pressure or containing pressurized gas, behind a bellows that is compressible for relieving pressure into the expansion volume.

FIG. 6 shows an example pressure relief system 122 in which the live valve 118 includes a bellows 602 in the valve body 604. The bellows 602 isolates the interstitial volume 230 from an additional volume 606 for the pressured fluid to expand into. As the pressure in the interstitial volume 230 increases, the bellows 602 contracts, thereby reducing the pressure in the interstitial volume 230. The additional expansion volume 606 in the valve body 604 can be at ambient pressure or can also be gas-charged to change the rate at which the pressure is relieved.

Other variations and alternative implementations of the pressure relief system 122 for gas lift can be constructed. For example, the piston 404, spring 502, and bellows 602 embodiments described above in FIGS. 4-6 can additionally include a pressure-activated device 304. Such additional embodiments combine the implementation of FIG. 3 with the implementations of FIGS. 4-6.

Likewise, the piston 404 and spring 502 implementations of FIGS. 4-5 can also be combined in various ways to provide a spring 502 inside of a bellows 602, providing a hybrid of the implementation in FIG. 6.

Figure 7:
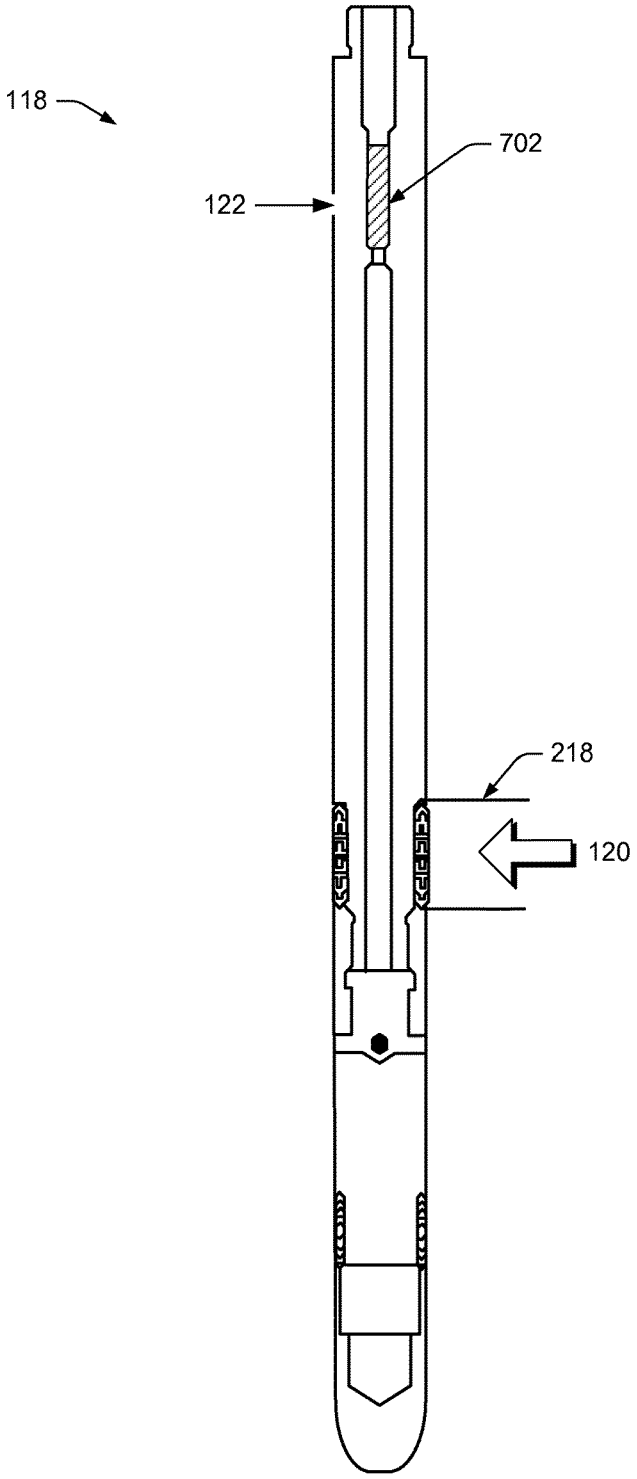
FIG. 7 is a diagram of an example pressure relief system for gas lift mandrels including a pressure relief valve within one of the gas lift valves to relieve a trapped interstitial pressure.

FIG. 7 shows an example pressure relief system 122 using a pressure relief valve 702 within one of the gas lift valves 116 or 118. In an implementation, the pressure confined in an interstitial space 230 of a barrier mandrel 114 can be relieved by venting the interstitial pressure to the tubing space 108 or to the casing space through the pressure relief valve 702. This pressure relief can be accomplished by inserting the pressure relief valve 702, as a valve-within-a-valve, into the live gas lift valve 118 or into the tubing-to-casing-barrier-valve (TCBV) 116. If inserted into the live gas lift valve 118, the pressure relief valve 702 will ultimately vent the excess pressure into the tubing conduit 108. If inserted into the TCBV valve 116, the pressure relief valve 702 will vent the excess pressure back into the space (i.e., annulus) between the outside of the production tubing 104 and the well casing 102.

Figure 8:
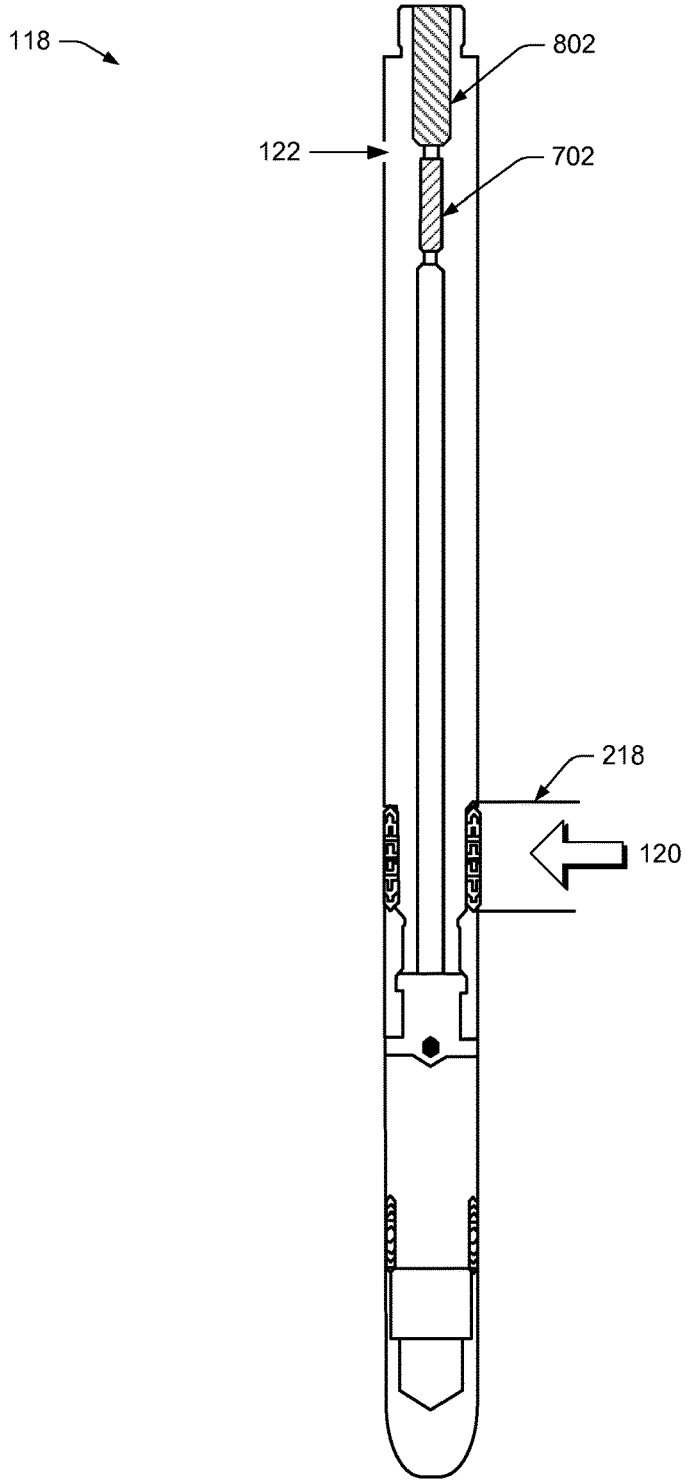
FIG. 8 is a diagram of an example pressure relief system for gas lift mandrels including a pressure relief valve in one of the gas lift valves to relieve a confined interstitial pressure, and including a check valve to prevent backflow through the pressure relief valve.

FIG. 8 shows an example pressure relief system 122 similar to that of FIG. 7, with a live valve 118 that includes within itself a pressure relief valve 702 to relieve pressure confined or trapped in the interstitial space 230, and also includes a check valve 802 to prevent backflow (or reverse flow). The check valve 802 prevents backflow from the venting destination back through the included pressure relief valve 702 to the interstitial space 230 being relieved of pressure.

Example Methods

Figure 9:
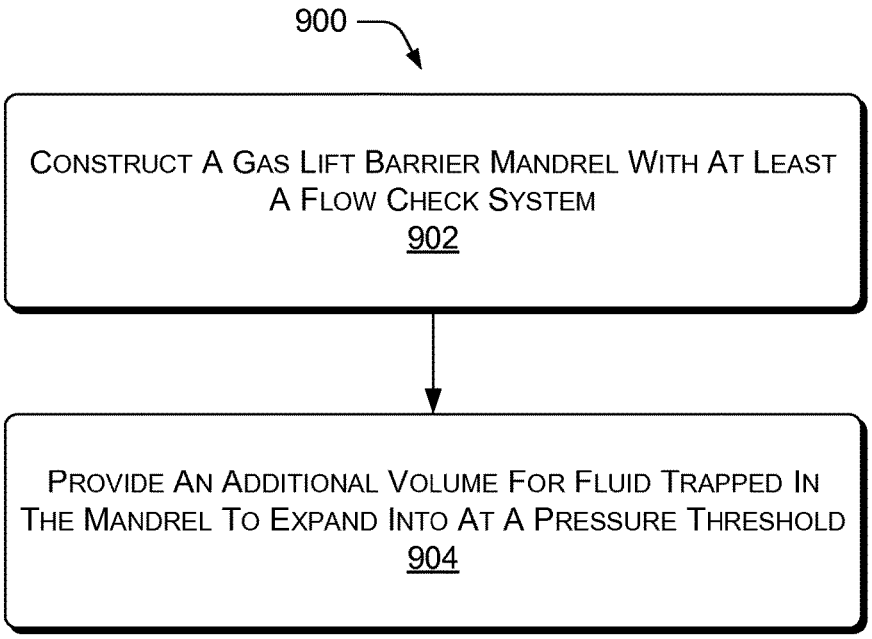
FIG. 9 is a flow diagram of an example method of constructing a pressure relief system for gas lift mandrels with an additional expansion volume for relieving a trapped pressure in the gas lift mandrel.

FIG. 9 shows an example method 900 of constructing a pressure relief system for gas lift. In the flow diagram, operations are shown in individual blocks.

At block 902, a gas lift mandrel is constructed with at least a flow check system.

At block 904, an additional volume is provided for fluid trapped in the mandrel to expand into at a given pressure threshold.

Figure 10:
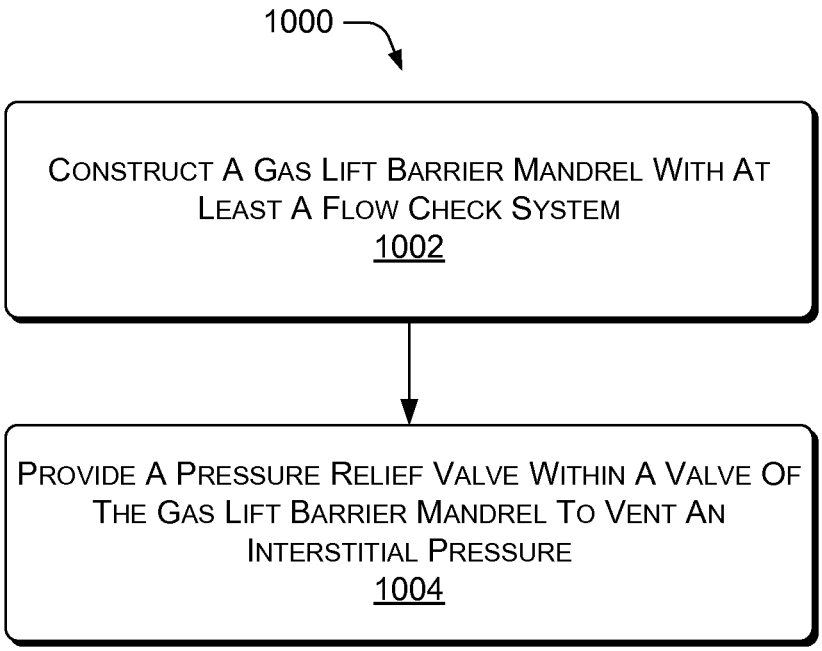
FIG. 10 is a flow diagram of an example method of constructing a pressure relief system for gas lift mandrels with a pressure relief valve for relieving a trapped pressure in the gas lift mandrel.

FIG. 10 shows an example method 1000 of constructing a pressure relief system for gas lift. In the flow diagram, operations are shown in individual blocks.

At block 1002, a gas lift mandrel is constructed with at least a flow check system.

At block 1004, a pressure relief valve is provided in one of the barrier mandrel valves to vent an interstitial pressure.

CONCLUSION

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

The invention claimed is:

1. An apparatus, comprising:

a gas lift mandrel;

at least a flow check system in the gas lift mandrel, the flow check system comprises two or more valves, wherein a valve of the two or more valves is selected from the group consisting of a live valve, a dummy valve, a shear orifice, a burst disk valve, and a flow control device; and wherein the valve temporarily or permanently prevents a fluid flow and confines a volume of the fluid within the gas lift mandrel;

an expansion volume in the gas lift mandrel reserved for relieving a pressure of a fluid confined in the gas lift mandrel beginning at a threshold pressure value;

a hollow valve body in the live valve providing the expansion volume;

a pressure-activated device at an opening of the expansion volume; and wherein the fluid becomes confined in an interstitial space between a tubing-to-casing-barrier valve and a live valve of the two or more valves and wherein when a pressure of the fluid reaches a predetermined pressure value then the pressure-activated device opens to allow at least a component of the fluid to expand into the expansion volume.

2. The apparatus of claim 1, further comprising a piston;

wherein the fluid expands against the piston to compress a gas or a gas charge in the expansion volume.

3. The apparatus of claim 2, further comprising a spring; and wherein the fluid expands against the piston to compress the spring.

4. The apparatus of claim 1, further comprising a bellows; and wherein the fluid expands to compress the bellows.

5. The apparatus of claim 4, wherein the fluid expands to compress a combination of the bellows and a spring.

6. An apparatus, comprising:

a gas lift mandrel;

at least a flow check system in the gas lift mandrel;

a pressure relief valve within a gas lift valve of the gas lift mandrel allowing a pressure of a fluid confined in the gas lift mandrel to vent from the gas lift valve;

wherein the flow check system comprises multiple gas lift valves in series fluid communication with each other; and wherein the pressure relief valve is contained within one of the multiple gas lift valves.

7. The apparatus of claim 6, wherein the multiple gas lift valves comprise a tubing-to-casing-barrier valve and a live gas lift valve; and the fluid is confined in an interstitial space between the tubing-to-casing-barrier valve and the live gas lift valve.

8. The apparatus of claim 7, wherein the pressure relief valve is included in the live gas lift valve and the pressure relief valve vents the pressure of the fluid into a production tubing of a well.

9. The apparatus of claim 7, wherein the pressure relief valve is included in the tubing-to-casing-barrier-valve and the pressure relief valve vents the pressure of the fluid into a casing space of a well.

10. A method, comprising:

constructing a gas lift mandrel with at least a flow check system;

providing a relief for a pressure of a confined fluid in the gas lift mandrel with an expansion volume in the gas lift mandrel reserved for relieving the pressure of the confined fluid beginning at a threshold pressure value; and wherein when the pressure of the confined fluid reaches a predetermined pressure value a pressure-activated device at an opening of the expansion volume opens to allow at least a component of the fluid to expand into the expansion volume against a resistance from a piston.

11. An apparatus, comprising:

a gas lift mandrel;

at least a flow check system in the gas lift mandrel;

an expansion volume in the gas lift mandrel reserved for relieving a pressure of a fluid confined in the gas lift mandrel beginning at a threshold pressure value;

a pressure-activated device at an opening of the expansion volume; and wherein when a pressure of the fluid reaches a predetermined pressure value then the pressure-activated device opens to allow at least a component of the fluid to expand into the expansion volume against a resistance selected from the group consisting of a gas charge, a piston, a spring and a bellows.

12. An apparatus, comprising:

a gas lift mandrel;

at least a flow check system in the gas lift mandrel;

a pressure relief valve within a gas lift valve of the gas lift mandrel allowing a pressure of a fluid confined in the gas lift mandrel to vent from the gas lift valve;

a check valve disposed between the pressure relief valve and a venting destination for the pressure of the fluid; and wherein the check valve prevents a reverse flow through the pressure relief valve.

13. The apparatus of claim 12, wherein the check valve is disposed within the gas lift valve; and wherein the check valve is in series fluid communication with the pressure relief valve within the gas lift valve.

* * * * *